US008429928B2

(12) United States Patent
Oelmaier et al.

(10) Patent No.: US 8,429,928 B2
(45) Date of Patent: Apr. 30, 2013

(54) REFRIGERATOR UNIT AND/OR FREEZER UNIT

(75) Inventors: Klaus Oelmaier, Ochsenhausen (DE); Viktor Laube, Ochsenhausen (DE)

(73) Assignee: Liebherr-Hausgeräte Ochsenhausen GmbH, Oschenhausen (DE)

( * ) Notice: Subject to any disclaimer, the term of this patent is extended or adjusted under 35 U.S.C. 154(b) by 833 days.

(21) Appl. No.: 12/287,078

(22) Filed: Oct. 6, 2008

(65) Prior Publication Data

US 2009/0151381 A1 Jun. 18, 2009

(30) Foreign Application Priority Data

Oct. 5, 2007 (DE) ..... 20 2007 013 945 U
Oct. 26, 2007 (DE) ..... 20 2007 014 887 U

(51) Int. Cl.
*F25D 19/02* (2006.01)

(52) U.S. Cl.
USPC ..... 62/448; 62/498

(58) Field of Classification Search ..... 62/448, 62/382, 77, 291, 298, 498, 259.1, 440, 454; 312/401, 405.1, 406
See application file for complete search history.

(56) References Cited

U.S. PATENT DOCUMENTS

| | | | | |
|---|---|---|---|---|
| 5,678,421 | A * | 10/1997 | Maynard et al. | 62/407 |
| 6,378,324 | B1 * | 4/2002 | Percy et al. | 62/448 |
| 6,519,970 | B1 * | 2/2003 | Rafalovich et al. | 62/448 |
| 6,701,739 | B2 * | 3/2004 | Morse | 62/277 |
| 6,718,793 | B2 * | 4/2004 | Lee | 62/453 |
| 7,055,582 | B2 * | 6/2006 | Erisgen | 165/122 |
| 7,448,225 | B2 * | 11/2008 | Iguchi et al. | 62/255 |
| 2004/0069464 | A1 * | 4/2004 | Erisgen | 165/121 |
| 2004/0168457 | A1 * | 9/2004 | Erisgen | 62/246 |
| 2005/0230087 | A1 * | 10/2005 | Erisgen | 165/121 |

FOREIGN PATENT DOCUMENTS

| | | | |
|---|---|---|---|
| DE | 10235487 | | 2/2004 |
| JP | 2002350035 | A * | 12/2002 |

OTHER PUBLICATIONS

Abstract of JP 2002-350035 A to Hirozawa et al.*
Translation of JP 2002-350035 A to Hirozawa et al.*

* cited by examiner

*Primary Examiner* — Mohammad Ali
(74) *Attorney, Agent, or Firm* — Dilworth & Barrese LLP.

(57) ABSTRACT

The invention relates to a refrigerator unit and/or a freezer unit comprising an assembly carrier on which one or more components of the unit serving cold production are arranged, with the assembly carrier being made such that it can be received in different installation positions in the unit, preferably in the unit base.

21 Claims, 2 Drawing Sheets

REFRIGERATOR UNIT AND/OR FREEZER UNIT

BACKGROUND OF THE INVENTION

The present invention relates to a refrigerator unit and/or a freezer unit having an assembly carrier on which one or more components of the unit serving cold production are arranged.

The assembly of components such as the compressor, fan, evaporation tray, condenser, etc., the soldering of tubes as well as the laying of cables is in particular made very difficult due to shortage of space with units having a unit base. To facilitate the assembly, the components such as the condenser, but also the evaporation tray, are sometimes not made in the ideal geometry, position and size, which can have the result that the refrigeration capacity is reduced with respect to an ideal design and arrangement of the components. A further disadvantage in known units consists of the fact that when the units are installed next to one another, warm exhaust air of the neighboring unit is sucked in as infeed air under certain circumstances.

To facilitate the assembly of the components, it is already known from the prior art in accordance with DE 102 35 487 A1 to arrange the components on an assembly carrier and then to push this into the unit. The arrangement known from the prior art admittedly facilitates the assembly of the components, but is comparatively inflexible and cannot be adapted, or can only be adapted with great difficulty, to different circumstances.

SUMMARY OF THE INVENTION

It is therefore the underlying object of the present invention to further develop a refrigerator unit and/or freezer unit of the initially named kind such that it enables a flexible use.

This object is solved, starting from a refrigerator unit and/or freezer unit of the initially named kind, in that the assembly carrier is made such that it can be installed in different installation positions in the unit, preferably in the unit base. A certain variability is thereby achieved so that, for example, it can be prevented by a reverse arrangement of the assembly carrier that the warm exhaust air of a unit influences the infeed air of a neighboring unit.

The desired variability is furthermore solved in accordance with a refrigerator unit and/or freezer unit having the features herein. Provision is made according to this that the assembly carrier is made such that the components can be installed at different positions and/or in different orientations on the assembly carrier. It is possible in this manner to provide a flexibly adaptable assembly carrier in which the components are not arranged at fixedly preset positions, but can rather be arranged in a variable manner.

It is generally conceivable to combine the two solutions represented above, i.e. to provide an assembly carrier which can be received in the unit in different installation positions, and further to configure the fastening positions of the assembly carrier such that the individual components can be received variably at different positions.

In a preferred embodiment of the invention, the assembly carrier is made symmetrical such that it can be received in the unit, preferably in the unit base, at positions mirrored with respect to one another. In this embodiment, the assembly carrier is thus a symmetrical component which can be installed into the unit base in a mirrored manner.

Provision is made in a further embodiment of the invention that the components serving cold production are a condenser and/or a compressor and/or an evaporation tray and/or a fan.

The fan is preferably arranged such that it serves the ventilation of the condenser, of the compressor or of other parts and/or the production of an airflow over the evaporation tray.

Provision is made in a further embodiment of the invention that a plurality of fastening positions are provided on the assembly carrier for at least one of the components. It is thus possible, for example, that the evaporation tray or the compressor can be installed at different positions on the assembly carrier. At least a plurality or all of the components arranged on the assembly carrier preferably have the same fastening elements so that their position is variable and can be swapped under certain circumstances.

To vary the flow direction, provision can be made that the fan is arranged such that it can be displaced or rotated such that the air can be conveyed in different directions, preferably in opposite directions.

Provision is made in a further embodiment of the invention that the assembly carrier has fastening positions for the components which are made such that the components are arranged rotatably at the fastening positions. This rotatable arrangement can, for example, provide a simplification for assembly purposes in that the respective component can be moved into a favorable position at least during assembly.

At the end of the assembly, the plate can then be put into the final position.

Such a rotatable arrangement of the components furthermore makes it possible in the long term, that is, not only during assembly, to realize an ideal position of the components on the assembly carrier, for example a mirrored arrangement of the components.

Provision is made in a further embodiment of the invention that one or more of the components, such as the evaporation tray, are made symmetrical.

Provision can furthermore be made that one or more components form a construction unit with other components or have holders for the fixing of other components. It is, for example, conceivable that one of the components is formed by an evaporation tray and that the evaporation tray has a holder for at least one fan and/or for a condenser.

Provision is made in a further embodiment of the invention that one of the components is formed by a condenser which has one or more spirally extending tube sections. Such a spiral condenser has the advantage that it is comparatively insensitive with respect to dirt or dust and that the shape of the condenser can moreover be adapted largely flexibly to the given installation conditions and/or flow conditions.

The condenser can have one or more spirally arranged columns.

Provision can furthermore be made that one of the components is formed by an evaporation tray and a further of the components is formed by a condenser, for example by a wire tube condenser or by a spiral condenser, with the condenser being arranged such that it projects at least partially into the evaporation tray.

The unit in accordance with the invention is preferably an undercounter unit. The unit is preferably an undercounter unit having ventilation in the base region.

BRIEF DESCRIPTION OF THE DRAWINGS

Further details and advantages of the present invention will be explained in more detail with reference to an embodiment shown in the drawing. There are shown.

DESCRIPTION OF THE PREFERRED EMBODIMENTS

Figure 1:
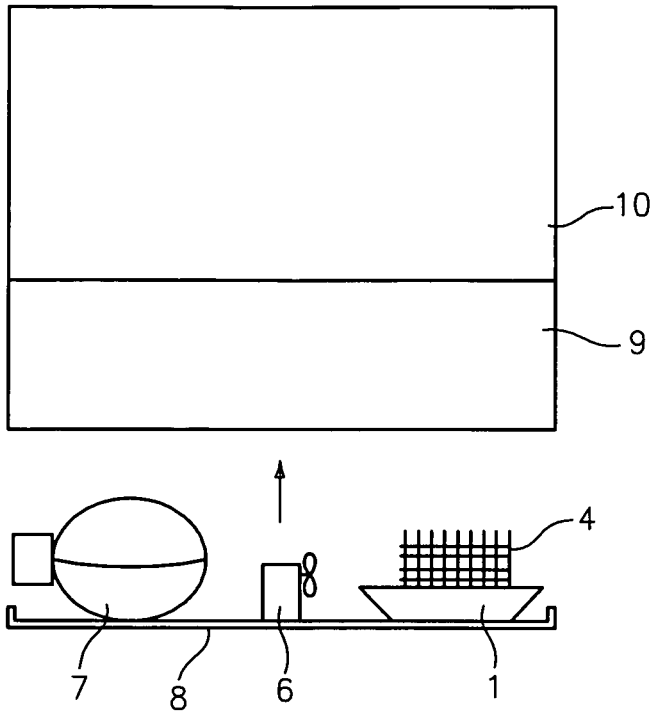
FIG. 1: a schematic representation of a preassembled assembly carrier before the insertion into the unit.

FIG. 1 shows with the reference numeral 8 an assembly carrier which is configured such that it forms a separate component which is inserted into the unit base 9 of the refrigerator unit and/or freezer unit 10 after assembly of the components shown, namely the evaporation tray 1, the condenser 4, the fan 6 and the compressor 7. The assembly carrier 8 can be latched or screwed to the base after insertion therein. Other fastening options are also conceivable.

The unit 10 is made as an undercounter refrigerator unit and/or as an undercounter freezer unit.

The assembly carrier 8 is made as a symmetrical component which can also be inserted into the unit base 9 in mirrored form.

Figure 2:
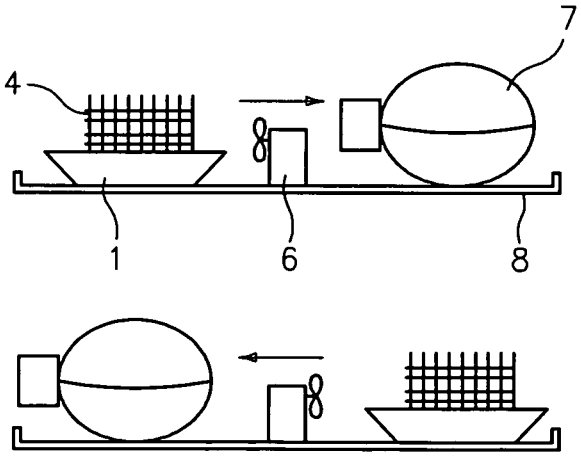
FIG. 2: schematic views of a symmetrically designed assembly carrier with different arrangements of the components.

Such an embodiment of a symmetrically arranged assembly carrier 8 is shown in FIG. 2 before and after rotation by 180°.

In addition to the mirrored arrangement of the assembly carrier 8, provision is made in accordance with FIG. 2 that the compressor 7 is likewise rotated by 180° on the assembly carrier 8.

Receiving points for the compressor 7 are provided at both sides of the assembly carrier 8.

As can be seen from FIG. 1, one or more holders or fastening positions are provided in the central region of the assembly carrier 8 for the fixing of the fan 6.

As can in particular be seen from FIG. 2, it is made possible by the symmetrical design of the assembly carrier 8 that the arrangement of the components can be reversed. Not only the possibility of a particularly variable arrangement of the components results from this, but also the possibility that, for example, the flow direction of the air conveyed by the fan 6 can be reversed, as is likewise indicated in FIG. 2.

Figure 3:
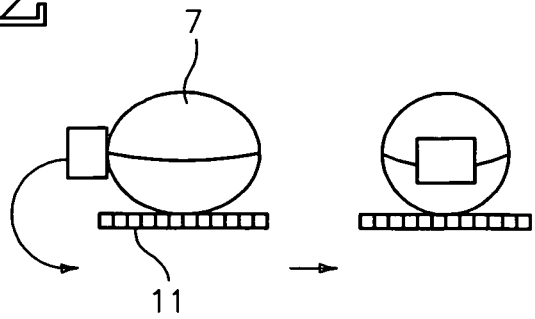
FIG. 3: schematic representations of a rotatable compressor plate.

As stated, one or more components can be arranged on a rotatable plate. The compressor 7 which is arranged on the rotatable plate 11 is shown here as an example in FIG. 3. Said plate can, for example, be unlatched and latched so that it is fixable in preferred positions. For assembly purposes, the plate 11 can, for example, be unlatched and the compressor 7 can thereby be rotated into a favorable assembly position. At the end of assembly, the plate 11 can again be moved into the final position and then latched.

As can be seen from FIG. 2, the rotatable arrangement of the compressor 7 can also be used to realize the mirrored installation of the compressor 7 should this be necessary.

Such a rotatable arrangement is naturally not only conceivable for the compressor 7, but also for other components.

The evaporation tray 1 has a symmetrical design.

It has the same fastening elements 2 (cf. FIG. 4) as the compressor 7 so that the two components can be fixed on the assembly carrier in a swappable manner. It is thus conceivable, for example, to install the evaporation tray 1 instead of the compressor 7. This identity of the fastening points is naturally not restricted to the compressor 7 and the evaporation tray 1, but can alternatively or additionally cover further components.

Figure 4:
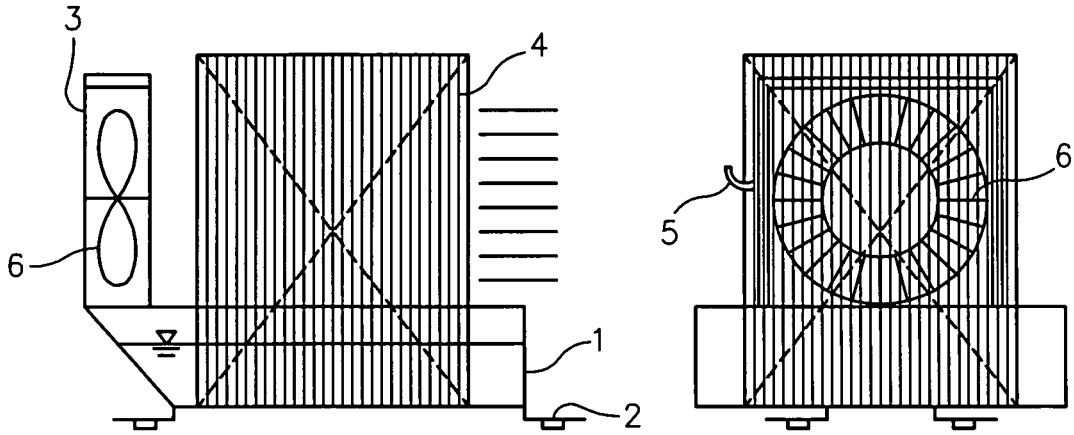
FIG. 4: schematic representations of an evaporation tray in different views with a condenser received therein as well as with a fan arranged at the evaporation tray and with holders for tubes, cables, etc.

As can furthermore be seen from FIG. 4, a holder for the condenser 4 as well as for a fan 6 for the ventilation of the condenser 4 is integrated in the evaporation tray 1. Provision can furthermore be made for the evaporation tray to have a defined and especially formed position at which an overflow of the condensed water into a collection tub provided for this purpose in the unit base is made possible. Reference numeral 3 in FIG. 4 denotes the holder for the fan 6.

As can be seen from FIG. 4, right hand representation, the evaporation tray 1 or the condenser 4 can have a special reception holder 5 for the reception or fastening of cables, tubes or further elements.

Figure 5:
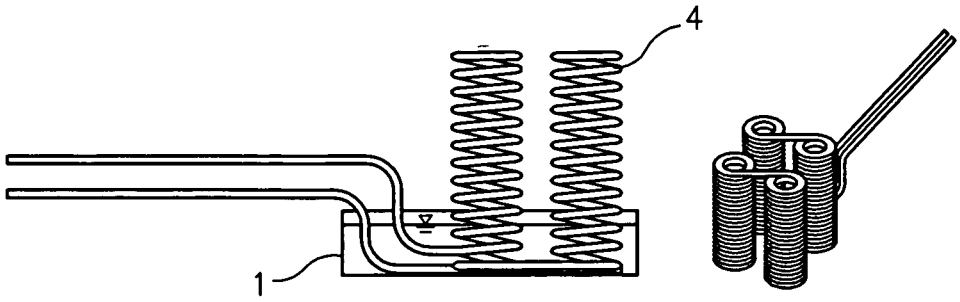
FIG. 5: schematic views of a spiral condenser in the state inserted into the evaporation tray and in a perspective representation.

As can be seen from FIG. 5, the condenser can be a spiral condenser. It comprises spiral columns arranged in a perpendicular manner. In the embodiment shown in FIG. 5, four such columns are shown; the invention is, however, naturally not restricted to this number.

A spiral condenser in accordance with FIG. 5 has the advantage in comparison with other condensers such as a wire tube condenser that it is comparatively insensitive to dirt and dust. A wire tube condenser can generally also be used within the framework of the present invention, for example.

A further advantage consists of the fact that the condenser in accordance with FIG. 5 can be adapted very flexibly to the given installation conditions and/or flow conditions with different variants.

The efficiency of the condenser 4 can also be optimized with certain throughflow directions of the spiral columns due to this flexibility.

The condenser 4 is arranged in the embodiments shown in FIGS. 4 and 5 in its lower region in the evaporation tray 1. It is generally likewise feasible to arrange the condenser 4 directly on the assembly carrier 8.

Due to the arrangement shown in FIG. 4 or FIG. 5, the condenser only has to be partially lacquered or coated since it is used in an evaporation tray 1 to increase the evaporation performance.

The spiral condenser 4 shown in accordance with FIG. 5 results in an increase in the evaporation performance with respect to wire tube condensers, for example, due to its shape on use in an evaporation tray 1 which brings about the advantage that an additional evaporation heating can be dispensed with.

The invention claimed is:

1. A refrigerator and/or freezer unit (10) comprising an assembly carrier (8) on which at least one component (1, 4, 6, 7) of the unit (10) serving cold production is arranged, wherein the assembly carrier (8) is configured to simultaneously be receivable in a variety of different installation positions in the unit (10), preferably in a unit base (9), and with the component(s) (1, 4, 6, 7) remaining arranged thereon, and the assembly carrier (8) has one or more fastening positions made such that different components can be interchanged at the same fastening position on the assembly carrier (8).

2. A refrigerator and/or freezer unit (10) in accordance with claim 1, wherein the assembly carrier (8) is made symmetrical such that it can be received in the unit (10), preferably in the unit base (8), in positions mirrored with respect to one another.

3. A refrigerator and/or freezer unit (10) in accordance with claim 1, wherein the components serving cold production are a condenser (4), and/or a compressor (7) and/or an evaporation tray (1) and/or a fan (6).

4. A refrigerator and/or freezer unit (10) in accordance with claim 1, wherein a plurality of fastening positions are provided on the assembly carrier (8) for at least one of the components.

5. A refrigerator and/or freezer unit (10) in accordance with claim 1, wherein one of the components is formed by a fan (6), with the fastening position for the fan (6) being made such that the fan (6) conveys air in different directions, preferably in opposite directions.

6. A refrigerator and/or freezer unit (10) in accordance with claim 1, wherein the assembly carrier (8) has fastening positions for the components which are made such that the components are arranged rotatably at the fastening positions.

7. A refrigerator and/or freezer unit in accordance with claim 6, wherein at least one fastening position is provided on a rotatable plate (11) rotatably mounted on the assembly carrier (8).

8. A refrigerator and/or freezer unit (10) in accordance with claim 1, wherein one or more of the components is/are arranged symmetrically.

9. A refrigerator and/or freezer unit (10) in accordance with claim 1, wherein one or more of the components form a constructional unit with other components or have holders for the fixing of other components.

10. A refrigerator and/or freezer unit (10) in accordance with claim 1, wherein one of the components is formed by an evaporation tray (1); and in that the evaporation tray (1) has a holder for a fan (6) and/or for a condenser (4).

11. A refrigerator and/or freezer unit (10) in accordance with claim 1, wherein one of the components is formed by a condenser (4) which has one or more spirally extending tube sections.

12. A refrigerator and/or freezer unit (10) in accordance with claim 11, wherein the condenser (4) has one or more spirally arranged columns.

13. A refrigerator and/or freezer unit (10) in accordance with claim 1, wherein one of the components is formed by an evaporation tray (1) and a further of the components is formed by a condenser (4), with the condenser (4) being arranged such that it is arranged at least partially in the evaporation tray (1).

14. A refrigerator and/or freezer unit (10) in accordance with claim 1, wherein one of the components is formed by a condenser which is made such that it can be adapted to the given installation conditions and/or flow conditions.

15. A refrigerator and/or freezer unit (10) in accordance with claim 1, wherein a plurality of components (1, 4, 6, 7) are secured on the carrier (8) and remained secured thereon in the variety of installation positions.

16. The refrigerator and/or freezer unit (10) in accordance with claim 1, comprising a compressor (7) and evaporation tray (1) having identical fastening elements (2), such that the compressor (7) and evaporation tray (1) are fixable on the assembly carrier (8) in swappable manner.

17. A refrigerator and/or freezer unit (10) comprising an assembly carrier (8) on which one or more components of the unit (10) serving cold production are arranged, wherein the assembly carrier (8) is configured such that the one or more components are installable at different positions and/or in a different orientation on the assembly carrier (8), and the assembly carrier (8) has one or more fastening positions made such that different components can be interchanged at the same fastening position on the assembly carrier (8).

18. A refrigerator and/or freezer unit (10) in accordance with claim 17, wherein the assembly carrier (8) is made such that it can be received in different installation positions in the unit (10), preferably in the unit base (9).

19. A refrigerator and/or freezer unit (10) in accordance with claim 17, wherein the assembly carrier (8) is made symmetrical such that it can be received in the unit (10), preferably in the unit base (8), in positions mirrored with respect to one another.

20. The refrigerator and/or freezer unit (10) in accordance with claim 17, comprising a compressor (7) and evaporation tray (1) having identical fastening elements (2), such that the compressor (7) and evaporation tray (1) are fixable on the assembly carrier (8) in swappable manner.

21. A refrigerator and/or freezer unit (10) comprising an assembly carrier (8) on which one or more components of the unit (10) serving cold production are arranged, wherein the assembly carrier (8) is configured such that the one or more components are installable at different positions and/or in a different orientation on the assembly carrier (8), and the assembly carrier (8) has fastening positions for the components which are made such that the components are arranged rotatably at the fastening positions, and at least one fastening position is provided on a rotatable plate (11) rotatably mounted on the assembly carrier (8).

* * * * *